US008811879B2

(12) United States Patent
Obata et al.

(10) Patent No.: US 8,811,879 B2
(45) Date of Patent: Aug. 19, 2014

(54) IMAGE FORMING METHOD

(71) Applicants: Hiroaki Obata, Tokyo (JP); Natsuko Fujisaki, Tokyo (JP); Koji Shibata, Tokyo (JP); Anju Hori, Tokyo (JP); Kishio Tamura, Tokyo (JP)

(72) Inventors: Hiroaki Obata, Tokyo (JP); Natsuko Fujisaki, Tokyo (JP); Koji Shibata, Tokyo (JP); Anju Hori, Tokyo (JP); Kishio Tamura, Tokyo (JP)

(73) Assignee: Konica Minolta Business Technologies, Inc, Tokyo (JP)

( * ) Notice: Subject to any disclaimer, the term of this patent is extended or adjusted under 35 U.S.C. 154(b) by 99 days.

(21) Appl. No.: 13/688,456

(22) Filed: Nov. 29, 2012

(65) Prior Publication Data

US 2013/0142554 A1 Jun. 6, 2013

(30) Foreign Application Priority Data

Dec. 5, 2011 (JP) ..... 2011-265791

(51) Int. Cl.
*G03G 11/00* (2006.01)
*G03G 9/087* (2006.01)

(52) U.S. Cl.
CPC ..... *G03G 11/00* (2013.01); *G03G 9/08791* (2013.01); *G03G 9/08755* (2013.01)
USPC ..... 399/340; 399/259

(58) Field of Classification Search
USPC ..... 399/340
See application file for complete search history.

(56) References Cited

FOREIGN PATENT DOCUMENTS

JP 2007-219105 8/2007

*Primary Examiner* — Clayton E LaBalle
*Assistant Examiner* — Jas Sanghera
(74) *Attorney, Agent, or Firm* — Lucas & Mercanti, LLP

(57) ABSTRACT

An image forming method that can obtain a high fixing strength and reduce the occurrence of a document offset phenomenon is provided.

In the image forming method the polyester resin forming the binder resin of the toner is obtained by condensing and polymerizing a carboxylic component containing at least one compound selected from chemical formula (1), (2) and (3) shown below that is an addition reactant of abietic acid and a carboxylic compound having an unsaturated double bond and an alcohol component, and the content of at least the one compound selected from the chemical formula (1), (2) and (3) in the carboxylic component is 5% by mass or more, and the fixing agent contains an alkylene carbonate which may have a substituent group or an aliphatic alkyl carboxylic acid ester which may have a substituent group.

Chemical formula (1)

-continued
Chemical formula (2)
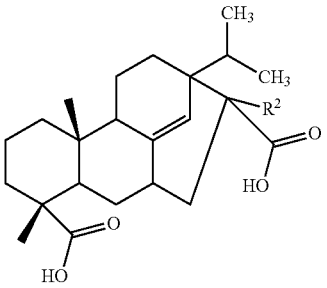
-continued
Chemical formula (3)
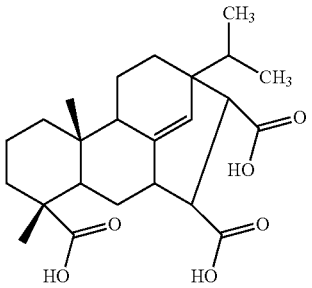
7 Claims, 2 Drawing Sheets

IMAGE FORMING METHOD

CROSS REFERENCE TO RELATED APPLICATION

This Application claims the benefit of priority of Japanese Patent Application No JP2011-265791, filed on Dec. 5, 2011 and which is incorporated by reference herein.

BACKGROUND OF THE INVENTION

1. Field of the Invention

The present invention relates to an image forming method using a wet-type fixing system.

2. Description of the Related Art

In recent years, in order to prevent global warming, it has been increasingly required to save energy in image forming devices such as printers and copying machines.

Conventionally, in an electrophotographic image forming method, as a method of fixing toner to an image support, a heating fixing system using a heating pressure roller and the like is adopted.

However, since, in the fixing method using the heating fixing system described above, the toner is allowed to adhere and fixed to the image support by being deformed, a large amount of energy is required. Hence, in recent years, it has been thought that it is difficult to meet the request of energy saving required for preventing global warming.

Moreover, as a fixing method for energy saving, a wet-type fixing system is proposed of swelling or partially dissolving toner to fix it to an image support with a fixing agent.

For example, Patent Literature 1 discloses a method of using a fixing agent containing a high-boiling ester in the form of bubbles and thereby fixing toner to an image support.

In the method described above, since a commercially available toner is used, and the affinity between a softening agent contained in the fixing agent and the toner is not examined, it is disadvantageously impossible to obtain a sufficient fixing strength of a formed image. In addition, after the supply of the fixing agent, the softening agent that is left and derived from the fixing agent disadvantageously causes a document offset phenomenon.

CITATION LIST

Patent Literature

[Patent Literature 1] Japanese Patent Application Laid-Open No. 2007-219105

SUMMARY OF THE INVENTION

Technical Problems

The present invention has been made based on the circumstances described above and an object of the present invention is to provide an image forming method in which, in the wet-type fixing system, a high fixing strength is obtained and the occurrence of the document offset phenomenon is reduced.

Means to Solve the Problems

To achieve at least one of the abovementioned objects, an image forming method reflecting one aspect of the present invention including an electrostatic latent image formation process of forming an electrostatic latent image on an electrostatic latent image carrier; a development process of forming a toner image by developing the electrostatic latent image with a dry developing agent including a toner containing a binder resin including a polyester resin; a transfer process of transferring the toner image to an image support; and a fixing agent supply process of supplying a fixing agent for swelling or dissolving the toner to the toner image transferred to the image support in which the polyester resin forming the binder resin of the toner is obtained by condensing and polymerizing a carboxylic component containing at least one compound selected from chemical formula (1), chemical formula (2) and chemical formula (3) shown below that is an addition reactant of abietic acid and a carboxylic compound having an unsaturated double bond and an alcohol component, and a content of at least the one compound selected from the chemical formula (1) the chemical formula (2) and the chemical formula (3) in the carboxylic component is 5% by mass or more, and the fixing agent contains an alkylene carbonate which may have a substituent group or an aliphatic alkyl carboxylic acid ester which may have a substituent group.

Chemical formula (1)

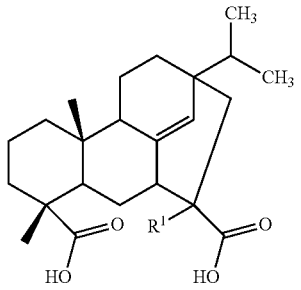

where $R^1$ is a hydrogen atom, a methyl group or —$CH_2COOH$.

Chemical formula (2)

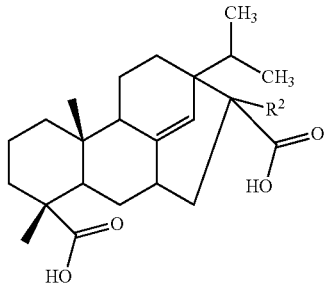

where $R^2$ is a hydrogen atom, a methyl group or —$CH_2COOH$.

Chemical formula (3)

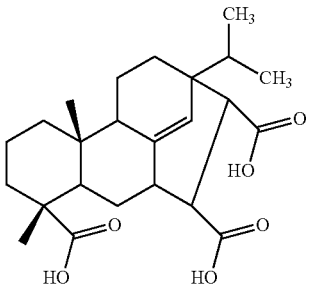

In the image forming method of the present invention, in the chemical formula (1), $R^1$ is preferably a hydrogen atom.

In the image forming method of the present invention, in the chemical formula (2), $R^2$ is preferably a hydrogen atom.

In the image forming method of the present invention, the aliphatic alkyl carboxylic acid ester is preferably ethyl 3-hydroxyhexanoate or glycol caprylate.

In the image forming method of the present invention, the fixing agent preferably contains 1,2-propylene carbonate.

In the image forming method of the present invention, a part or the whole of the polyester resin forming the binder resin of the toner is isocyanate-modified, and the fixing agent preferably contains water and a polyvalent amine compound.

Moreover, the polyvalent amine compound is preferably isophoronediamine.

Advantageous Effects of Invention

According to the image forming method of the present invention, in a wet-type fixing system, the polyester resin forming the binder resin is obtained by condensing and polymerizing a carboxylic component containing at least one compound selected from chemical formula (1), chemical formula (2) and chemical formula (3) shown above that is an addition reactant of abiotic acid and a carboxylic compound having an unsaturated double bond and an alcohol component, and the content of the addition reactant is 5% by mass or more, and the fixing agent for swelling or dissolving a toner contains an alkylene carbonate which may have a substituent group or an aliphatic alkyl carboxylic acid ester which may have a substituent group. Thus, it is possible to obtain a high fixing strength in a formed image and reduce the occurrence of a document offset phenomenon.

DESCRIPTION OF THE EMBODIMENTS

Figure 1:
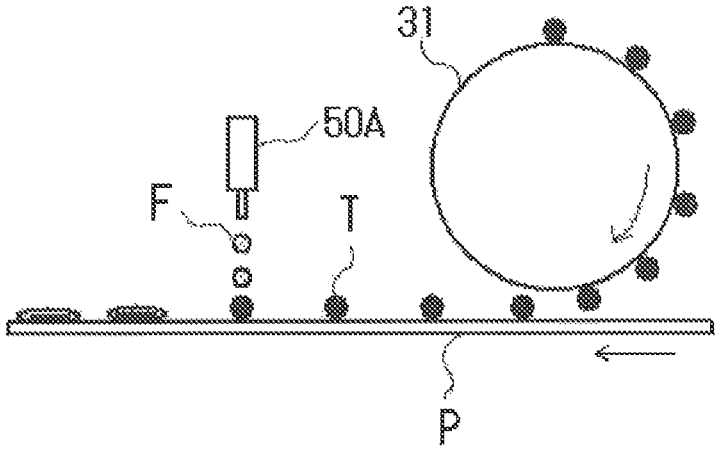
FIG. 1 is a cross-sectional view for illustrating an example of the configuration of fixing agent supply means used in an image forming method according to the present invention.

The present invention will be described in detail below.

[Image Forming Method]

An image forming method of the present invention is an image forming method of a wet-type fixing system that includes at least an electrostatic latent image formation process of forming an electrostatic latent image on an electrostatic latent image carrier; a development process of forming a toner image by developing the electrostatic latent image with a dry developing agent including a toner containing a binder resin including a polyester resin; a transfer process of transferring the toner image to an image support; and a fixing agent supply process of supplying a fixing agent for swelling or dissolving the toner to the toner image transferred to the image support. In this fixing agent supply process, the toner image transferred to the image support is fixed to the image support.

[Electrostatic Latent Image Formation Process]

The electrostatic latent image formation process is a process of forming the electrostatic latent image on the electrostatic latent image carrier.

The electrostatic latent image carrier is not particularly limited; examples of the electrostatic latent image carrier include a drum-shaped carrier formed with an inorganic photoreceptor such as amorphous silicon or selenium or an organic photoreceptor such as polysilane or phthalopolymethine.

The formation of the electrostatic latent image is performed by, for example, uniformly charging the surface of the electrostatic latent image carrier with charging means and exposing the surface of the electrostatic latent image carrier with exposure means in an image-wide exposure manner.

The charging means and the exposure means are not particularly limited; means that are generally used in an electrophotographic system can be used.

[Development Process]

The development process is a process of developing the electrostatic latent image with the dry developing agent including the toner containing the binder resin including a polyester resin to form the toner image.

The formation of the toner image is performed by using the dry developing agent including the toner containing the binder resin including a polyester resin and using, for example, an agitator that performs frictional agitation of the toner to charge it and development means that is formed with a rotatable magnet roller. Specifically, in the development means, for example, the toner and a carrier are mixed and agitated, and the resulting friction allows the toner to be charged, the toner is retained on the surface of the rotating magnet roller and a magnetic brush is formed. Since the magnet roller is arranged in the vicinity of the electrostatic latent image carrier, part of the toner forming the magnetic brush formed on the surface of the magnet roller is moved to the surface of the electrostatic latent image carrier by electrical attraction force. Consequently, the electrostatic latent image is developed by the toner, and the toner image is formed on the surface of the electrostatic latent image carrier.

<Toner>

The toner used in the image forming method of the present invention is composed of toner particles that contain at least the binder resin including a polyester resin. The toner particles may contain, as necessary, an internal additive such as a coloring agent, a releasing agent or a charge control agent; an external additive such as a fluidizer may be externally added to the toner particles.

In the toner used in the image forming method of the present invention, the diameter of the particle is preferably, as a volume-based median diameter, equal to or more than 3.5 μm but equal to or less than 7.0 μm, and is more preferably equal to or more than 5.0 μm but equal to or less than 6.5 μm.

The toner in which the volume-based median diameter falls within the range described above is used, and thus the specific surface area of the toner is sufficiently ensured and therefore, in the fixing agent supply process, which will be described later, the contact area with the fixing agent is sufficiently ensured. Hence, the toner image can be reliably fixed onto the image support, and thus it is possible to obtain a sufficient fixing strength in a formed image.

When the toner in which the volume-based median diameter is less than 3.5 μm is used, the formed image is likely to be rough. On the other hand, when the toner in which the volume-based median diameter exceeds 7.0 μm is used, the specific surface area of the toner is low and, in the fixing agent supply process, which will be described later, the contact area with the fixing agent is not sufficiently ensured. Hence, it is likely that the toner image cannot be reliably fixed onto the image support.

In the present invention, the volume-based median diameter of the toner is measured and calculated using a measurement device in which a computer system having data processing software "Software V3.51" installed is connected to "Coulter Multisizer 3" (made by Beckman Coulter, Inc.).

Specifically, 0.02 g of tire toner is added to and wetted with 20 mL of a surfactant solution (for dispersing the toner particles, for example, a surfactant solution obtained, by ten-fold diluting, with pure water, a neutral detergent containing a surfactant component), and thereafter ultrasonic dispersion is performed for one minute and the toner dispersion liquid is prepared; the toner dispersion liquid is injected with a pipet into a beaker containing "ISOTON II" (made by Beckman Coulter, Inc.) within a sample stand until the concentration displayed on the measurement device becomes 8%. Here, it is possible to obtain a reproducible measurement value within the concentration range described above. Then, in the measurement device, the measurement particle count number is set at 25,000, the diameter of the aperture is set at 50 μm, a range of 1 to 30 μm that is the measurement range is divided into 256 parts, a frequency value is calculated, and a particle diameter of 50% from the largest side of volume integral fractions is designated as the volume-based median diameter.

In the toner used in the image forming method of the present invention, in terms of enhancement of transfer efficiency, the average degree of circularity of the toner particles is preferably 0.930 to 1.000, and is more preferably 0.950 to 0.995.

In the present invention, the average degree of circularity of the toner particles is measured using "FPIA-2100" (made by Sysmex Corporation).

Specifically, a sample is wetted with an aqueous solution containing a surfactant, ultrasonic dispersion processing is performed for one minute and the sample is dispersed, and thereafter it is photographed with "FPIA-2100" (made by Sysmex Corporation), in a measurement condition HPF (high magnification image sensing) mode, at a proper concentration of a HPF detection number of 3,000 to 10,000, the degrees of circularity of individual toner particles are calculated according to the following expression (T), the degrees of circularity of the individual toner particles are added and the calculation is performed by dividing the resulting value by the total number of toner particles.

degree of circularity=(circumference length of a circle having a projection area equal to a particle image)/(circumference length of a particle projection image) Expression (T):

In terms of heat resistant storage and blocking resistance, in the toner used in the image forming method of the present invention, its glass-transition temperature is preferably 30 to 70° C., and is more preferably 35 to 50° C.

In the present, invention, the glass-transition temperature of the toner is measured using a differential scanning calorimeter "DSC8500" (made by PerkinElmer Co., Ltd.).

Specifically, 4.5 mg of a sample is precisely weighed with a balance to two places of decimals, is sealed in an aluminum pan and is set in a DSC-7 sample holder. As a reference, an empty aluminum pan is used, temperature control of heat-cool-heat is performed at a measurement temperature of 0 to 200° C., a temperature rise rate of 10° C./minute, a temperature drop rate of 10° C./minute and analysis is performed based on data in the second heat. The value of an intersection between an extension line of a base line before the rise of the first endothermic peak and a tangent indicating the maximum inclination between the rise part of the first endothermic peak and the peak apex is designated as the glass-transition temperature.

(Binder Resin)

Although the binder resin contained in the toner particles composing the toner used in the image formation of the present invention contains a polyester resin, smother resin may be contained together with the polyester resin. Examples of the another resin include a styrene resin, a (meth)acrylic resin and a styrene-(meth)acrylic resin. Note that, the proportion of the resin is preferably 50% by mass or less of the binder resin.

In the present invention, the polyester resin forming the binder resin is obtained by using, as raw materials, a carboxylic component containing an addition reactant of abietic acid and a carboxylic compound having an unsaturated double bond and an alcohol component and by subjecting them to condensation polymerization.

Specifically, the addition reactant of abietic acid and a carboxylic compound having an unsaturated double bond is an addition reactant obtained by performing the Diels-Alder reaction of abietic acid among the resin acids forming rosin and a carboxylic component having an unsaturated double bond such as acrylic acid, methacryl acid, maleic acid, fumaric acid, itaconic acid, citraconic acid, glutaconic acid, isododecenyl succinic acid, n-dodecenyl succinic acid or n-octenyl succinic acid.

In the present invention, as the polyester resin forming the binder resin, a resin obtained by performing condensation polymerization of the carboxylic component containing the addition reactant of the abietic acid and the carboxylic compound having an unsaturated double bond with an alcohol component are used, and thus, since the addition reactant has an affinity for an image support such as paper, it is possible to obtain a high fixing strength in a formed image, and the polyester resin obtained from a compound containing this addition reactant as an acid component has a high hardness, with the result that the occurrence of the document offset phenomenon is considered to be reduced. Furthermore, the abietic acid forming this addition reactant is bio-derived, and thus it is possible to reduce environmental loads.

The addition reactant is at least one compound selected from chemical formula (1), chemical formula (2) and chemical formula (3) described above; specifically, the addition reactant is preferably an addition reactant of any one of (meth)acrylic acid, fumaric acid and maleic acid with abietic acid.

A content of the addition reactant that is at least one compound selected from chemical formula (1), chemical formula (2) and chemical formula (3) is 5% by mass or more of a carboxylic component, and is more preferably equal to or more than 7% by mass but equal to or less than 15% by mass.

The content of the addition reactant is 5% by mass or more, and thus it is possible to reliably obtain a high fixing strength in a formed image and reliably reduce the occurrence of the document offset phenomenon.

When the content of the addition reactant is less than 5% by mass, since it is impossible to obtain a high fixing strength in a formed image, the document offset phenomenon may occur.

As the carboxylic component, another polycarboxylic acid may be used together with the addition reactant. Examples of the polycarboxylic acid include as non-radical polymerizable compounds: aliphatic carboxylic acids such as an oxalic acid, a malonic acid, a succinic acid, a glutaric acid, an adipic acid, a pimelic acid, a suberic acid, an azelaic acid, a sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradodecane dicarboxylic acid, 1,16-hexadecane dicarboxylic acid and 1,18-octadecane dicarboxylic acid; lower alkyl esters and acid anhydrides of these aliphatic carboxylic acids; aromatic carboxylic acids such as an isophthalic acid, a terephthalic acid, an orthophthalic acid, t-butylisophthalic acid, 2,6-naphthalene dicarboxylic acid and 4,4'-biphenyl dicarboxylic acid; and trivalent or more polycarboxylic acids such, as a trimellitic acid and a pyromellitic acid.

Furthermore, examples of the polycarboxylic acid include as compounds having an unsaturated group; unsaturated aliphatic dicarboxylic acids such as a maleic acid, a fumaric acid, an itaconic acid, a citraconic acid, a glutaconic acid, an isododecenyl succinic acid, an n-dodecenyl succinic acid and an n-octenyl succinic acid; acid chlorides or acid anhydrides of these compounds; and unsaturated aromatic carboxylic acids such as a caffeic acid.

They can be used singly or as a combination of two or more.

The alcohol component is not particularly limited as long as it is a polyhydric alcohol. Examples of the alcohol component include as non-radical polymerizable compounds: aliphatic diols such as ethylene glycol, 1,3-propanediol, 1,4-butanediol, 1,5-pentanediol, 1,6-hexanediol, 1,7-heptanediol, 1,8-octanediol, 1,9-nonanediol, 1,10-dodecanediol, 1,11-undecanediol, 1,12-dodecanediol, 1,13-tridecanediol, 1,14-tetradecanediol, 1,18-octadecanediol, and 1,20-eicosanediol; bisphenols such as bisphenol A and bisphenol F; and alkylene oxide adducts of bisphenols such as ethylene oxide adducts and propylene oxide adducts of these compounds. Examples of the trivalent or more polyhydric alcohols include glycerin, pentaerythritol, trimethylolpropane and sorbitol.

Examples of the alcohol component include as compounds having an unsaturated group: compounds having an unsaturated double bond such as 2-butene-1,4-diol, 3-butene-1,6-diol, 4-butene-1,8-diol and 9-octadecene-7 and 12-diol; and compounds having an unsaturated triple bond such as 2-butyne-1,4-diol and 3-butyne-1,4-diol.

They can be used singly or as a combination of two or more.

The polyester resin can be manufactured by condensing and polymerizing the alcohol component and the carboxylic component in an atmosphere of an inert gas at a temperature of 120 to 250° C. In the condensation polymerisation, a known esterification catalyst may be used as necessary.

In the present invention, the polyester resin may be a resin in which a part or the whole thereof is isocyanate-modified (hereinafter also referred to as an "isocyanate-modified polyester resin").

Examples of the isocyanate-modified polyester resin include a compound obtained by making, for example, a polycondensate of the alcohol component and the carboxylic compound having an active hydrogen group react with a polyvalent isocyanate compound at a temperature of, for example, 40 to 140° C. In this reaction, a solvent can be used as necessary.

Examples of the active hydrogen group include a hydroxyl group (an alcoholic hydroxyl group and a phenolic hydroxyl group), an amino group, a carboxyl group and a mercapto group; of them, an alcoholic, hydroxyl group is preferably used.

Examples of the polyvalent isocyanate compound include: aliphatic polyisocyanates such as a tetramethylene diisocyanate, a hexamethylene diisocyanate, 2,6-diisocyanatomethyl caproate; cycloaliphatic polyisocyanates such as an isophorone diisocyanate and a cyclohexylmethane diisocyanate; aromatic diisocyanates such as a tolylene diisocyanate and a diphenylmethane diisocyanate; aromatic aliphatic diisocyanates such as α,α,α',α'-tetramethyl xylylene diisocyanate; and compounds obtained by using two or more of these.

Examples of the solvent that can be used include solvents which are inactive against a polyvalent isocyanate compound of toluene, xylene, acetone, methyl ethyl ketone, methyl isobutyl ketone, ethyl acetate, dimethylformamide, dimethylacetamide and tetrahydrofuran.

The weight average molecular weight of the polyester resin is preferably 3,000 to 60,000, and is more preferably 3,800 to 22,000. Moreover, the number average molecular weight of the polyester resin is preferably 2,000 to 20,000, and is more preferably 2,200 to 11,000.

When the weight average molecular weight and the number average molecular weight of the polyester resin are excessively low, it is likely that the strength of the toner particles is lowered and that broken toner particles contaminate the image forming device. On the other hand, when the weight average molecular weight and the number average molecular weight of the polyester resin are excessively high, it is likely that softening at the time of fixing is insufficiently performed, and that the fixing strength becomes insufficient.

In the present invention, the weight average molecular weight of the polyester resin is measured by gel permeation chromatography (GPC).

Specifically, a GPC device "HLC-8220" (made by Tosoh Corporation) and a column "TSK guard column+TSK gel Super HZM-M, 3 in series" (made by Tosoh Corporation) are used; while the column is held at a temperature of 40° C., tetrahydrofuran (THF) is made to flow at a flow rate of 0.2 mL/minute as a carrier solvent; a sample is dissolved in the THF such that the concentration becomes 1 mg/mL on a dissolving condition in which the sample is processed at room temperature with an ultrasonic dispersing machine for five minutes; then a sample solution is obtained by performing processing with a membrane filter having a pore size of 0.2 μm; 10 μL of the sample solution is injected into the device together with the carrier solvent; detection is performed with a refractive index detection unit (RI detection unit); and calculation is performed using a calibration curve obtained by measuring the molecular weight distribution of the sample by use of monodispersed polystyrene standard particles. Ten points are used as the polystyrene for the measurement of the calibration curve.

The glass-transition temperature of the polyester resin is preferably 40 to 70° C., and is more preferably 45 to 54° C.

The glass-transition temperature of the polyester resin falls within the range described above, and thus the heat resistant storage and softening performed with the fixing agent are facilitated.

In the present invention, the glass-transition temperature of the polyester resin is measured with a differential scanning calorimeter "Diamond DSC" (made by PerkinElmer Co., Ltd.).

Specifically, 4.5 mg of a sample is precisely weighed with a balance to two places of decimals, is sealed in an aluminum pan and is set in a DSC-7 sample holder. As a reference, an empty aluminum pan is used, temperature control of heat-cool-heat is performed at a measurement temperature of 0 to 200° C., a temperature rise rate of 10° C./minute, a temperature drop rate of 10° C./minute and analysis is performed based on data in the second heat. The value of an intersection between an extension line of a base line before the rise of the first endothermic peak and a tangent indicating the maximum inclination between the rise part of the first endothermic peak and the peak apex is assumed to be the glass-transition temperature.

(Coloring Agent)

When the toner particles forming the toner used in the image formation of the present invention contain a coloring agent, the coloring agent is not particularly limited. A known pigment can be used.

Examples of a black coloring agent include carbon black, copper oxide, manganese dioxide, aniline black, activated carbon, non-magnetic ferrite, magnetic ferrite and magnetite.

Examples of a yellow coloring agent include chrome yellow, zinc yellow, cadmium yellow, yellow iron oxide, mineral fast yellow, nickel titanium yellow, navel yellow, naphthol yellow S, hansa yellow G, hansa yellow 10G, benzidine yellow G, benzidine yellow GR, quinoline yellow lake, permanent yellow NCG and tartrazine lake.

Examples of an orange coloring agent include red chrome yellow, molybdenum orange, permanent orange GTR, pyrazolone orange, vulcan orange, indanthrene brilliant orange RK, benzidine orange G and indanthrene brilliant orange GK.

Examples of a red coloring agent include quinacridone, red iron oxide, cadmium red, red lead, mercury sulfide, cadmium, permanent red 4R, lithol red, pyrazolone red, watching red, calcium salt, lake red C, lake red D, brilliant carmine 6B, eosin lake, rondamin lake B, alizarin lake and brilliant carmine 3B.

Examples of a violet coloring agent include manganese violet, fast violet B and methyl violet lake.

Examples of a blue coloring agent include prussian blue, cobalt blue, alkali blue lake, victoria blue lake, phthalocyanine metallic blue, metal-free phthalocyanine blue, phthalocyanine blue part chlorination product, fast sky blue and indanthrene blue BC.

Examples of a green coloring agent include chrome green, chromium oxide, pigment green B, mica light, green lake and final yellow green G.

Examples of a white coloring agent include zinc oxide, titanium oxide, antimony white and zinc sulfide.

One or a combination of two or more of these coloring agents can be used.

The content of the coloring agent is preferably 1 to 10 parts by mass to 100 parts by mass of the binder resin, and is more preferably 2 to 9 parts by mass.

(Releasing Agent)

When the toner particles forming the toner used in the image formation of the present invention contain a releasing agent, there is a wax as the releasing agent. Specific examples of the wax include:

(1) Polyolefin Waxes polyethylene wax, polypropylene wax and the like (2) Long-Chain Hydrocarbon Waxes paraffin wax, sasol wax and the like (3) Dialkyl Ketone Waxes distearyl ketone and the like (4) Ester Waxes carnauba wax, montan wax, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, behenyl behenate, stearyl stearate, tristearyl trimellitate, distearyl maleate and the like (5) Amide Waxes ethylenediamine dibehenyl amide, tristearyl trimellitate amide and the like The content of the releasing agent is preferably 5 to 30 parts by mass to 100 parts by mass of the binder resin, and is more preferably 10 to 25 parts by mass.

(Charge Control Agent)

When the toner particles forming the toner used in the image formation of the present invention contain a charge control agent, the charge control agent is not particularly limited as long as the charge control agent is a substance that can provide a positive or negative charge by friction charge. Various known positive charge control agents and negative charge control agents can be used.

(External Additive)

Although the toner particles composing the toner used in the image formation of the present invention can be used without being processed, in order for fluidity, charging, cleaning and the like to be improved, external additives such as a fluidizing agent and a cleaning aid are added to the toner particles and they can be used.

Examples of the fluidizing agent include inorganic fine particulates formed of, for example, silica, alumina, titanium oxide, zinc oxide, iron oxide, copper oxide, lead oxide, antimony oxide, yttrium oxide, magnesium oxide, barium titanate, ferrite, red iron oxide, magnesium fluoride, silicon carbide, boron carbide, silicon nitride, zirconium, nitride, magnetite and magnesium stearate.

These inorganic fine particulates are preferably subjected to surface processing using a silane coupling agent, a titanate coupling agent, a higher fatty acid, a silicone oil and the like so that dispersion over the surface of the toner particles and environmental stability are enhanced.

Examples of the cleaning aid include polystyrene fine particles, polymethyl methacrylate fine particles and the like.

As the external additive, various substances can be combined and used.

The added ratio of the external additive is preferably 0.1 to 20% by mass of the whole toner.

As the method of manufacturing the toner described above, there are known methods such as dry methods, for example, a pulverization method and wet methods, for example, a dissolution desolvation method.

The dissolution desolvation method will be specifically described below.

(1) Resin Solution Preparation Step

In a resin solution preparation step, a resin solution that contains a resin mixture containing at least a binder resin and a water-insoluble organic solvent which can dissolve the binder resin is prepared. Here, the resin solution is a solution in which at least the binder resin is dissolved in the water-insoluble organic solvent and the other components are dissolved or dispersed in the water-insoluble organic solvent.

The polyester resin forming the binder resin can be manufactured by condensing and polymerizing, for example, the alcohol component and the carboxylic component described above in an atmosphere of an inert gas at a temperature of 120 to 250° C. In the condensation polymerization, a known esterification catalyst such as a tetrabutoxy titanate or a dibutyltin oxide may be used as necessary.

When, as the binder resin, an isocyanate-modified polyester resin is used, and it is cross-linked with a divalent amine compound, as the polyester resin, a polycondensate having an active hydrogen group that is made to further react with a polyvalent isocyanate compound at a temperature of, for example, 40 to 140° C. can be used.

The water-insoluble organic solvent used in the resin solution is not particularly limited as long as the binder resin used is soluble and is water-insoluble; a known solvent can be used. Examples thereof include ketones such as methyl ethyl ketone and diethyl ketone, ethers such as diethyl ether, esters such as butyl acetate and ethyl acetate, alcohols such as butanol and aromatics such as toluene and xylene.

The resin solution can be prepared by dissolving, suspending or dispersing the binder resin, the coloring agent and other internal additives in the water-insoluble organic solvent with an emulsifying machine or a dispersing machine. Here, the emulsifying machine and the dispersing machine are not particularly limited; a known machine can be used. Examples thereof include: batch type emulsifying machines such as "Ultra Turrax" (made by IKA Co., Ltd.) "Polytron homogenizer" (made by Kinematiea Co., Ltd.), "TK Auto homo mixer" (made by Tokushukika Co., Ltd.) and "National Cooking Mixer" (Matsushita Electric Industrial Co., Ltd.); continuous emulsifying machines such as "Ebara Milder" (Ebara Manufacturing Co., Ltd.), "TK Pipeline homo mixer", "TK Homomic line flow" and "Fillmix" (made by Tokushukika Co., Ltd.), "Colloid mil" (made by KOBELCO Pantech Co., Ltd.), "Slasher" and "Trigonal wet fine grinding machine" (made by Mitsui Miike Chemical Engineering Co., Ltd.), "Cavitron" (made by Eurotech Co., Ltd.) and "Fine flow mill" (made by Pacific Machinery & Engineering Co., Ltd.); and batch or continuous two-way emulsifying machines such as "Clearmix" (made by M Technique Co., Ltd.) and "Fillmix" (made by Tokushukika Co., Ltd.).

(2) Aqueous Medium Preparation Step

In an aqueous medium preparation step, an aqueous medium containing a dispersing agent and water is prepared.

The dispersing agent is not particularly limited as long as it can facilitate the dispersion of oil droplet particles, which will be described later; for example, an alkaline earth metal salt in which its solubility for water is lower (poorly water-soluble alkaline earth metal salt) can be used.

The solubility for water of the poorly water soluble alkaline earth metal salt is not particularly limited; its solubility in 1 L of water maintained at a temperature of 20° C. is preferably 50 mg or less, and is more preferably 30 mg or less.

Examples of the poorly water-soluble alkaline earth metal salt include a calcium carbonate and a calcium phosphate, a magnesium carbonate and a magnesium phosphate and a barium carbonate, a barium phosphate and a barium sulfate. Among them, in order to minimize the range of the particle distribution of the obtained toner particles and make the shapes uniform, a calcium carbonate and a calcium phosphate are preferably used.

One dispersing agent can be used singly or two or more dispersing agents are used together.

The aqueous medium may contain a dispersion stabilizer together with the dispersing agent. The dispersion stabilizer is added, and thus it is possible to prevent the dispersing agent from being aggregated in the aqueous medium and thereby enhance dispersibility. Since the dispersion stabilizer is present in water in a state close to primary particles, its water dispersibility is satisfactory and the dispersibility is not lowered even if its concentration is increased and thus the adjustment of the concentration is easily performed.

Examples of the dispersion stabilizer include a surfactant and a water-soluble polymer compound and metal salts and ammonium salts thereof.

Examples of the surfactant include sodium dodecyl benzene sulfate, sodium tetradecyl sulfate, sodium pentadecyl sulfate, sodium octyl sulfate, sodium dodecyl benzenesulfonate, sodium oleate, sodium laurate, sodium stearate and potassium stearate.

Examples of the water-soluble polymer compound include polyvinyl alcohol, polyvinyl pyrrolidone, hydroxyethyl cellulose, carboxymethyl cellulose, cellulose gum, a polyacrylic acid and a polycarboxylic acid.

One dispersion stabilizer can be used singly or two or more dispersion stabilizers are used together.

(3) Oil Droplet Particle Dispersing Liquid Preparation Step

In an oil droplet particle dispersing liquid preparation step, the resin solution prepared in the previous step and the aqueous medium are mixed, the resin solution is dispersed in the aqueous medium and thus a dispersing liquid where oil droplet particles of the resin solution are dispersed in the aqueous medium is prepared.

The mixing of the resin solution and the aqueous medium is preferably performed under agitation and is more preferably performed while a shearing force is being applied. Here, heating or heating and the application of a pressure may be performed. More specifically, the mixing of the resin solution and the aqueous medium is performed with, for example, an emulsifying machine and a dispersing machine. Such an emulsifying machine and a dispersing machine are commercially available. Specific examples thereof include: batch type emulsifying machines such as "Ultra Turrax" (made by IKA Co., Ltd.), "Polytron homogenizer" (made by Kinematica Co., Ltd.), and "TK Auto homo mixer" (made by Tokushukika Co., Ltd.); continuous emulsifying machines such as "Ebara Milder" (Ebara Manufacturing Co., Ltd.), "TK Pipeline homo mixer", "TK homomic line flow" and "Fillmix" (made by Tokushukika Co., Ltd.), "Colloid mil" (made by KOBELCO Pantech Co., Ltd.), "Slasher" and "Trigonal wet fine grinding machine" (made by Mitsui Miike Chemical Engineering Co., Ltd.), "Cavitron" (made by Eurotech Co., Ltd.) and "Fine flow mill" (made by Pacific Machinery & Engineering Co., Ltd.); and "Clearmix" (M Technique Co., Ltd.) and "Fillmix" (made by Tokushukika Co., Ltd.). In addition to these, the commercially available emulsifying machine and the dispersing machine that are used for preparing the resin solution described above can also be used.

(4) Water-Insoluble Organic Solvent Removal Step

In a water-insoluble organic solvent removal step, the water-insoluble organic solvent contained in the oil droplets is removed from the oil droplet particle dispersing liquid obtained in the oil droplet particle dispersing liquid preparation step, and resin particles are generated.

The removal of the water-insoluble organic solvent can be performed by, for example, distillation under reduced pressure.

(5) Dispersing Agent Removal Step

In a dispersing agent removal step, the dispersing agent that is left on the surface of the resin particles after the removal of the water-insoluble organic solvent is decomposed and removed.

The removal of the dispersing agent from the surface of the resin particles can be performed by, for example, the addition of an ionic substance to the mixture liquid after the removal of the water-insoluble organic solvent.

The ionic substance is not particularly limited as long as the ionic substance has water solubility, dissociates in water to decompose the dispersing agent and thereby increases the water solubility of the dispersing agent; a known ionic substance can be used. Among them, an acid such as an inorganic acid or an organic acid is preferably used. As the inorganic acid, a known inorganic acid can be used; among them, a water-soluble inorganic acid such as hydrochloric acid, sulfuric acid, nitric acid or carbonic acid is preferably used, and hydrochloric acid is particularly preferably used. As the organic acid, a known organic acid can be used; among them, a water-soluble organic acid, such as formic acid or acetic acid is preferably used, and acetic acid is particularly preferably used.

(6) Separation-Washing-Drying Step

In a separation-washing-drying step, the resin particles are separated from the mixture liquid containing the resin particles in which the dispersing agent is decomposed and removed from the surface in the dispersing agent removal step, and are washed and dried and thus the toner particles are obtained.

The separation and collection of the resin particles from the mixture liquid can be performed according to a known method; for example, the separation and collection can be performed by filtration, suction filtration or centrifugation. In this step, before the separation of the toner particles, washing may be performed. After the separation of the toner particles, washing may be performed.

The drying can be performed according to a known method such as a freeze-drying method or an air current drying method.

(7) External Additive Addition Step

In an external additive addition step, the external additive is added to the toner particles obtained.

The addition of the external additive can be performed according to a generally performed known method.

<Dry Developing Agent>

The developing agent used in the image forming method of the present invention is a dry developing agent; it may be a one-component developing agent formed with only a magnetic or non-magnetic toner or a two-component developing agent formed by mixing a toner and a carrier.

In the case of the two-component developing agent, as the carrier, a magnetic particle can be used, that is formed with a conventional material such as a metal, for example, iron, ferrite or magnetite or an alloy of the metal and another metal such as aluminum or lead; in particular, a ferrite particle is preferably used. As the carrier, a resin-coated carrier obtained by coating the surface of a magnetic particle with a coating agent or a dispersed carrier obtained by dispersing a magnetic fine powder in a binder resin may be used.

In the carrier, the diameter of the particle is preferably, as a volume-based median diameter, 15 to 100 μm, and is more preferably 20 to 80 μm.

The volume-based median diameter or the carrier can be typically measured with a laser diffraction type particle size distribution measuring device "HELOS" (Sympatec GmbH) that includes a wet dispersing machine.

[Transfer Process]

A transfer process is a process in which the toner image is transferred to the image support.

The transfer of the toner image to the image support is performed by separately charging the toner image to the image support.

As transfer means, for example, a corona transfer unit using corona discharge, a transfer belt or a transfer roller can be used.

Moreover, for example, the transfer process can be performed as follows: an intermediate transfer member is used and the toner image is primarily transferred to the intermediate transfer member, and thereafter the toner image is secondarily transferred to the image support; or the toner image formed on the electrostatic latent image carrier is directly transferred to the image support.

The image support is not particularly limited; examples thereof include: plain paper ranging from thin paper to cardboard; coated print paper such as high-quality paper, art paper or coat paper; commercially available Japanese paper and postcard paper; a plastic film for OHP; and a cloth.

[Fixing Agent Supply Process]

A fixing agent supply process is a process in which the fixing agent for swelling or dissolving the toner is supplied to the toner image transferred to the image support.

The supply of the fixing agent to the toner image is performed by injecting, spraying or applying a liquid or bubble-like fixing agent.

Examples of fixing agent supply means include an inkjet nozzle and a roller.

<Fixing Agent>

The fixing agent used in the image forming method of the present invention swells or dissolves the toner, and contains, as a softening agent, an alkylene carbonate which may have a substituent group or an aliphatic alkyl carboxylic acid ester which may have a substituent group. The fixing agent of the present invention may contain not only the softening agent described above but also components such as water and a surfactant.

Examples of the alkylene carbonate include an ethylene carbonate and a propylene carbonate. Among them, 1,2-propylene carbonate is preferably used.

Examples of the aliphatic alkyl carboxylic acid ester include a diethoxyethyl succinate, a dibutoxyethyl succinate, a dimethoxyethyl adipate, a diethoxyethyl adipate, ethyl 3-hydroxyhexanoate and a glycol caprylate.

In the fixing agent used in the image forming method of the present invention, as described above, when the polyester resin forming the binder resin of the toner includes an isocyanate-modified polyester resin, the fixing agent is supplied to the toner image by combination with a polyvalent amine compound contained in the fixing agent, and thereafter an isocyanate site is urea-bonded to an amine site to form a cross-link, with the result that the fixing strength in a formed image is further enhanced. In this case, the fixing agent contains water and a surfactant together with a polyvalent amine compound, and contains an alkylene carbonate or an aliphatic alkyl carboxylic acid ester as the softening agent. Water acts as a dilution component of an alkylene carbonate or an aliphatic alkyl carboxylic acid ester, and as a solvent of a polyvalent amine compound.

The specific examples of the polyvalent amine compound include a divalent amine compound and a trivalent amine compound.

Examples of the divalent amine compound include: aromatic diamines such as phenylene diamine, diethyl toluene diamine and 4,4'-diaminodiphenylmethane; alicyclic diamines such as 4,4'-diamino-3,3'-dimethyl dicyclohexyl methane, diamine cyclohexane and isophorone diamine; and aliphatic diamines such as ethylene diamine, tetramethylene diamine and hexamethylene diamine.

Examples of the trivalent amine compound include: diethylenetriamine and triethylenetetramine.

As the polyvalent amine compound, among them, isophorone diamine is preferably used because it is highly reactive with an isocyanate-modified polyester resin.

The content of the polyvalent amine compound is preferably 0.1 to 20.0% by mass to the total amount of the fixing agent. When the content of the polyvalent amine compound is less than 0.1% by mass, the effect of obtaining a high fixing strength is reduced whereas, when the content of the polyvalent amine compound exceeds 20.0% by mass, this causes an unpleasant odor.

The content of water is preferably 5 to 70% by mass to the total amount of the fixing agent.

Furthermore, examples of the surfactant include an anionic surfactant, a cationic surfactant and a nonionic surfactant. Examples of the anionic surfactant include: higher fatty acid salts such as sodium laurate, sodium myristate, and sodium oleate; alkyl aryl sulfonic acid salts such as sodium dodecylbenzenesulfonate; alkyl sulfate ester salts such as sodium dodecyl sulfate; polyoxyethylene alkyl ether sulfuric acid ester salts such as polyethoxylated ethylene sodium lauryl ether sulfate; polyoxyethylene alkyl aryl ether sulfuric acid ester salts such as polyoxyethylene nonylphenyl sodium ether sulfate; alkylsulfosuccinic acid ester salts such as sodium monooctyl sulfosuccinate, sodium, dioctyl sulfosuccinate, and sodium polyoxyethylene lauryl sulfosuccinate; and derivatives thereof. Moreover, examples of the cationic surfactant include: an aliphatic amine salt, an aliphatic quaternary ammonium salt, a benzalkonium salt, a benzethonium chloride, a pyridinium salt and an imidazolinium salt. Furthermore, examples of the nonionic surfactant include: polyoxyethylene alkyl ethers such as a polyoxyethylene lauryl ether and a polyoxyethylene stearyl ether; polyoxyethylene alkyl phenyl ethers such as a polyoxyethylene nonylphenyl ether; sorbitan higher fatty acid esters such as sorbitan monolaurate sorbitan monostearate, sorbitan trioleate; polyoxyethylene sorbitan higher fatty acid esters such as polyoxyethylene sorbitan monolaurate; polyoxyethylene higher fatty acid esters such as polyoxyethylene monolaurate and polyoxyethylene monostearate; glycerin higher fatty acid esters such as oleic acid monoglyceride and stearic acid monoglyceride; and a polyoxyethylene-polyoxypropylene-block copolymer.

In the fixing agent supply process, the fixing agent which is 0.05 to 0.5 times as much as she mass of the toner for forming the toner image, and which is more preferably 0.05 to 0.3 times as much as the mass is supplied.

When an excessively small amount or fixing agent is supplied, a sufficient fixing strength may not be obtained. On the other hand, when an excessively large amount of fixing agent is supplied, image bleeding and the document offset phenomenon may occur.

Note that, the "mass of the toner for forming the toner image" is the amount of toner necessary to visualize the electrostatic latent image formed in the electrostatic latent image formation process.

The method of supplying the fixing agent will be specifically described below.

FIG. 1 is a cross-sectional view for illustrating an example of the configuration of the fixing agent supply means used in the image forming method according to the present invention.

The fixing agent supply means 50A is comprised of a line type inkjet nozzle, and is arranged on the downstream side of a toner image carrier 31.

In the fixing agent supply means 50A described above, the fixing agent F formed in the shape of liquid droplets is supplied, according to the region of a toner image T transferred to the image support P, to the toner image T.

A line type inkjet comprising the fixing agent supply means 50A described above preferably has a resolution of 300 dpi or more. In addition, the size of the liquid droplet of the inkjet is preferably 0.5 to 50 pl.

Note that, when the inkjet nozzle is used as the fixing agent supply means 50A, the fixing agent needs to be resistant to a solvent.

Moreover, when the fixing agent is not liquid at room temperature or when the viscosity of the fixing agent is high, a heater can be provided in the fixing agent supply means 50A.

Figure 2:
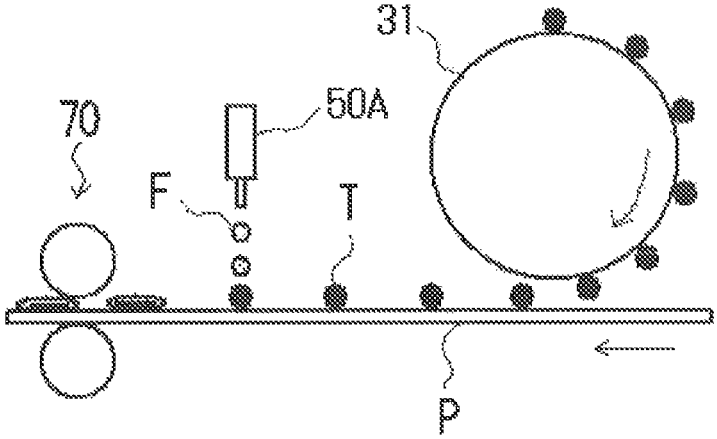
FIG. 2 is a cross-sectional view for illustrating an example of the configuration of the fixing agent supply means and pressure addition means used in the image forming method according to the present invention.

In the present invention, after the fixing agent supply process, a pressure application process of applying a pressure to the toner image T to which the fixing agent F has been supplied can be performed. Specifically, as shown in FIG. 2, after the fixing agent supply process, it is possible to apply, with pressure application means 70 comprised of a pair of pressure rollers, a pressure to the toner image T to which the fixing agent F has been supplied.

As the pressure application means, for example, rollers whose surfaces are separable or the like can also be used. The applied pressure is not particularly limited; for example, it is preferably 50 to 700 kPa.

The pressure application process described above is performed, and thus it is possible to obtain a high fixing strength in a formed image.

Figure 3:
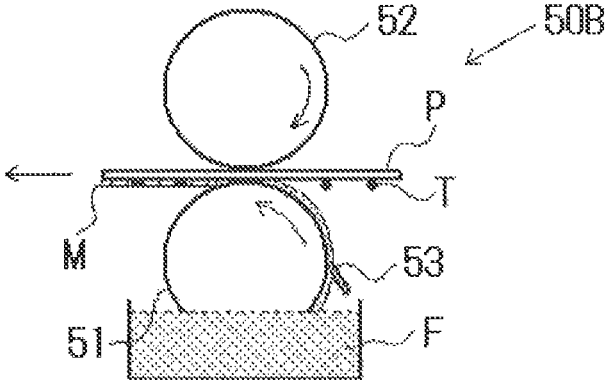
FIG. 3 is a cross-sectional view for illustrating another example of the configuration of the fixing agent supply means used in the image forming method according to the present invention.

FIG. 3 is a cross-sectional view for illustrating another example of the configuration of the fixing agent supply means used in the image forming method according to the present invention.

The fixing agent supply means 50B described above is comprised of a fixing agent application roller 51 and a pressure roller 52 provided opposite the fixing agent application roller 51. Part of the fixing agent application roller 51 is immersed in, for example, the liquid fixing agent F. Moreover, a metaling blade 53 that controls the amount of fixing agent F supplied onto the toner image T is provided with an end thereof separated from the surface of the fixing agent application roller 51.

In the fixing agent supply means 50B described above, the rotational driving of the fixing agent application roller 51 and the pressure roller 52 causes the supply amount of liquid fixing agent F on the fixing agent application roller 51 to be regulated by the metaling blade 53, the fixing agent F is supplied, as a liquid film M, to the entire surface of the image support P having the toner image T transferred and a pressure is applied to the pressure roller 52.

The thickness of the liquid film M is not particularly limited; for example, it is preferably 1 to 100 μm.

For example, the pressure applied by the pressure roller 52 is preferably 150 to 250 kPa.

Figure 4:
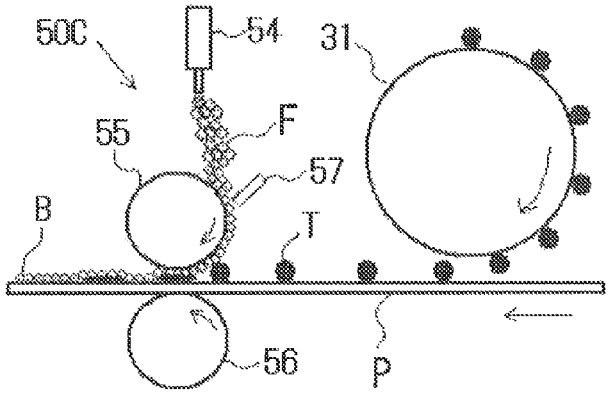
FIG. 4 is a cross-sectional view for illustrating yet another example of the configuration of the fixing agent supply means used in the image forming method according to the present invention.

FIG. 4 is a cross-sectional view for illustrating yet another example of the configuration of the fixing agent supply means used in the image forming method according to the present invention.

The fixing agent supply means 50C described above is comprised of a bubble generation device 54 that generates the bubble-like fixing agent, a fixing agent application roller 55 and a pressure roller 56 provided opposite the fixing agent application roller 55. Furthermore, a regulation blade 57 that controls the amount of fixing agent F supplied onto the toner image T is provided with an end thereof separated from the surface of the fixing agent application roller 55.

In the fixing agent supply means 50C described above, the rotational driving of the fixing agent application roller 55 and the pressure roller 56 causes the supply amount of bubble-like fixing agent F on the fixing agent application roller 55 to be regulated by the regulation blade 57, the fixing agent F is supplied, as a bubble-like film B, to the entire surface of the image support member P having the toner image T transferred and a pressure is applied to the pressure roller 56.

The thickness of the bubble-like film. B is not particularly limited; for example, it is preferably 50 to 80 μm.

For example, the pressure applied by the pressure roller 56 is preferably 150 to 250 kPa.

The image forming method of the present invention can be performed by, for example, an image forming device described below.

Figure 5:
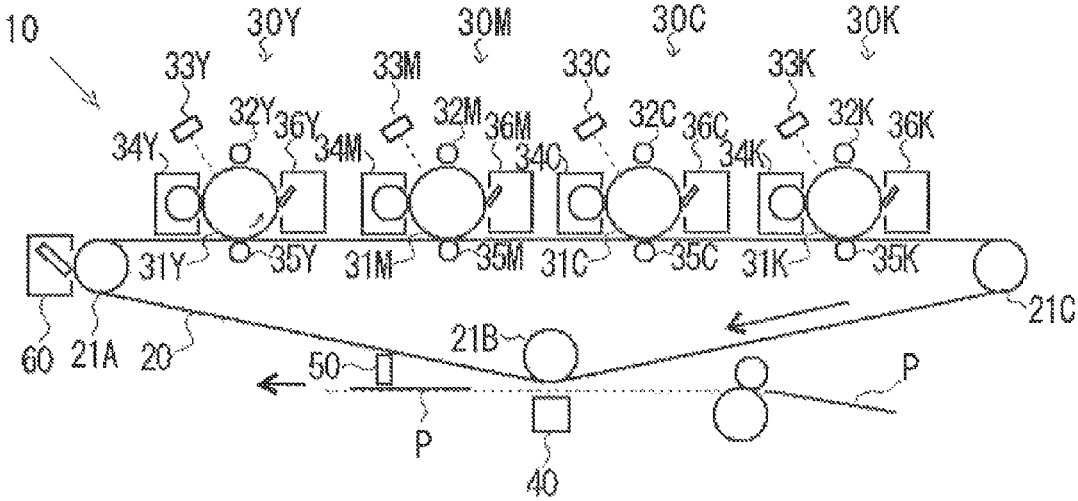
FIG. 5 is a schematic view snowing an example of the configuration of an image forming device used in the image forming method according to the present invention.

FIG. 5 is a schematic diagram showing an example of the configuration of the image forming device used in the image forming method according to the present invention.

The image forming device 10 described above is a tandem type full color image forming device; the image forming device 10 includes a plurality of image formation units 30Y, 30M, 30C and 30K provided along a belt-shaped intermediate transfer member 20, secondary transfer means 40 that transfers toner images formed on the intermediate transfer member 20 by the image formation units to the image support P and fixing agent supply means 50 that supplies the fixing agent to the toner images transferred onto the image support P.

The image formation unit 30Y is a unit that forms a toner image of yellow, and includes a drum-shaped photoreceptor 31Y which is an electrostatic latent image carrier; charging means 32Y, exposure means 33Y, developing means 34Y, primary transfer means 35Y and cleaning means 36Y are arranged around the photoreceptor 31Y.

The image formation units 30M, 30C and 30K have the same configuration as that of the image formation unit 30Y except that they each form toner images of magenta, cyan, and black instead of the formation of a toner image of yellow.

The intermediate transfer member 20 is stretched around a plurality of support rollers 21A, 21B and 21C, and is supported such that the intermediate transfer member 20 can move circularly.

The secondary transfer means 40 is formed with a transfer unit that separately charges and transfers the toner image to the image support member P.

The fixing agent supply means 50 supplies the fixing agent in the shape of liquid droplets to the toner image, and is composed of, for example, the line type inkjet nozzle.

The image forming device 10 performs the following image formation processing.

In the image formation, unit 30Y, when the photoreceptor 31Y is driven and rotated, the charging means 32Y applies an even potential to the surface of the photoreceptor 31Y through corona discharge having the same polarity as the toner. On the surface of the evenly charged photoreceptor 31Y, an electrostatic latent image is formed by scanning and exposure parallel to the direction of rotation of the photoreceptor 31Y by the exposure means 33Y. Then, the developing means 34Y makes the toner charged to have the same polarity as the surface potential of the photoreceptor 31Y adhered to the electrostatic latent image of the photoreceptor 31Y and performs reversal development to form the toner image, and the primary transfer means 35Y transfers it onto the circularly moved intermediate transfer member 20. These types of processing are also performed on the image formation units 30M, 30C and 30K, and the toner images of the individual colors formed by the image formation units 30Y, 30M, 30C and 30K are superimposed on the intermediate transfer member 20 to form a color toner image. The color toner image is secondarily transferred by the secondary transfer means 40 onto the image support P that is transported with predetermined timing. Then, the fixing agent supply means 50 supplies, based on image data, the fixing agent to the toner image secondarily transferred to the image support P. The toner image to which the fixing agent has been supplied is fixed to the image support P, and thus an image is formed.

On the other hand, after the secondary transfer means 40 transfers the color toner image to the image support P, cleaning means 60 removes the untransferred toner left on the intermediate transfer member 20 having the image support member P subjected to curvature separation. Moreover, cleaning means 36Y, 36M, 36C and 36K remove the untransferred toner left on the photoconductive members 31Y, 31M, 31C and 31K.

According to the image forming method of the present invention, in the wet-type fixing system, the polyester resin forming the binder resin contains the carboxylic component containing the addition reactant of the abietic acid and the polyester resin forming the binder resin is formed by condensation and polymerization of the carboxylic component containing the addition reactant of the abietic acid and the carboxylic compound having an unsaturated double bond and an alcohol component; the content of the addition reactant is equal to or more than 5% by mass; and the fixing agent which swells or melts the toner contains an alkylene carbonate or an aliphatic alkyl carboxylic acid ester. Thus, it is possible to obtain a high fixing strength in a formed image and reduce the occurrence of the document offset phenomenon.

It can be considered that the polyester resin forming the binder resin is obtained from a compound containing, as an acid component, the addition reactant of the abietic acid and the carboxylic compound having an unsaturated double bond, and that, since the addition reactant has a high affinity for the image support such as paper, it is possible to obtain a high fixing strength in a formed image. It can also be considered that, since the polyester resin obtained from the compound containing the addition reactant as the acid component has a high hardness, it is possible to reduce the occurrence of the document offset phenomenon.

EXAMPLES

Although the present invention will be described in detail below using examples, the present invention is not limited to only the examples which will be described below.

Example 1 of the Manufacturing of the Toner (1) Resin Solution Preparation Step 675 parts by mass of a bisphenol A ethylene oxide 2 mole adduct, 88 parts by mass of a bisphenol A propylene oxide 2 mole adduct, 250 parts by mass of terephthalic acid, 31 parts by mass of the addition reactant (a compound represented by chemical formula (1) where $R^1$ is a hydrogen atom) of abietic acid and acrylic acid and 2 parts by mass of a dibutyltin oxide were put into a reaction container with a cooling tube, an agitation unit and a nitrogen introduction tube, were made to react at a normal pressure, and a temperature of 230° C. for seven hours, and furthermore were made to reach at a reduced pressure of 10 to 15 mmHg for five hours, with the result that a polyester resin [1] was obtained. The polyester resin [1] had a weight-average molecular weight of 8000, a number average molecular weight of 2,300 and a glass-transition temperature of 54° C.

Ethyl acetate of 1,500 parts by mass was added to 290 parts by mass of the polyester resin [1], 85 parts by mass of behenyl behenate (melting point: 71° C.) and 45 parts by mass of carbon black, and they were increased to 75° C. while being agitated. Thereafter, they were agitated at a temperature of 75° C. for three hours, with the result that a resin solution [1] whose solid content was 25% by mass was obtained.

(2) Aqueous Medium Preparation Step

A solution obtained by dissolving and dispersing, into 580 parts by mass of pure water, 5 parts by mass of tricalcium phosphate as a dispersing agent and 0.05 part by mass of sodium dodecylbenzene sulfonate as a dispersion stabilizer was agitated with "TK homo mixer" (made by Tokushukika Co., Ltd.) at a rate of 5000 rpm for 15 minutes, with the result that a milky white aqueous medium [1] was obtained.

(3) Oil Droplet Particle Dispersing Liquid Preparation Step

The resin solution [1] of 600 parts by mass was added to the aqueous medium [1], and they were agitated with "TK homo mixer" at a rate of 12,000 rpm for 30 minutes, with the result that an oil droplet particle dispersing liquid [1] was prepared.

(4) Water-Insoluble Organic Solvent Removal Step, (5) Dispersing Agent Removal Step and (6) Separation-Washing-Drying Step The oil droplet particle dispersing liquid [1] was moved to a pressure reducing distillation device, and ethyl acetate, which was a water-insoluble organic solvent, was removed at a reduced pressure. Hydrochloric acid of 1 mol/l was added to the obtained slurry until the pH of the slurry became 1, they were left for 30 minutes, and tricalcium phosphate was removed from the surface of the resin particles. Thereafter, filtration, washing and drying were performed, and thus toner particle [1] whose volume-based median diameter was 5.2 μm were obtained.

(7) External Additive Addition Step

Hydrophobic silica of 1.0 part by mass was mixed with 100 parts by mass of the toner particle [1] using a Henschel mixer. They were mixed for 20 minutes with a rotary vane rotated at a circumferential speed of 24 m/s, and were thereafter passed through a sieve having 400 MESH, with the result that a toner [1] was obtained.

Example 2 of the Manufacturing of the Toner

In (1) resin solution preparation step of the example 1 of the manufacturing of the toner, a polyester resin [2] was likewise made except that 31 parts by mass of the addition reactant of abietic acid and acrylic acid was changed to 9 parts by mass; a toner [2] was likewise made except that the polyester resin [2] was used instead of the polyester resin [1]. Note that, the polyester resin [2] had a weight-average molecular weight of 8,100, a number average molecular weight of 2,400 and a glass-transition temperature of 58° C.

Example 3 of the Manufacturing of the Toner

In (1) resin solution preparation step of the example 1 of the manufacturing of the toner, an isocyanate-modified polyester resin [3] was likewise made except that a step of obtaining, after the polyester resin [1] was obtained, an isocyanate-modified polyester resin by adding isophorone diisocyanate was added; a toner [3] was likewise made except that the isocyanate-modified polyester resin [3] was used instead of the polyester resin [1]. Note that, the isocyanate-modified polyester resin [3] had a weight-average molecular weight of 8,200, a number average molecular weight of 2,500 and a glass-transition temperature of 61° C.

Example 4 of the Manufacturing of the Toner

In (1) resin solution preparation step of the example 2 of the manufacturing of the toner, an isocyanate-modified polyester resin [4] was likewise made except that a step of obtaining, after the polyester resin [2] was obtained, an isocyanate-modified polyester resin by adding isophorone diisocyanate was added; a toner [4] was likewise made except that the isocyanate-modified polyester resin [4] was used instead of the polyester resin [2]. Note that, the isocyanate-modified polyester resin [4] had a weight-average molecular weight of 8,800, a number average molecular weight of 2,500 and a glass-transition temperature of 63° C.

Example 5 of the Manufacturing of the Toner

In (1) resin solution preparation step of the example 1 of the manufacturing of the toner, a polyester resin [5] was likewise made except that the addition reactant (a compound represented by chemical formula (1) where $R^1$ is a hydrogen atom) of abietic acid and acrylic acid was changed to the addition reactant (a compound represented by chemical formula (1) where $R^1$ is a methyl group) of abietic acid and metacrylic acid; a toner [5] was likewise made except that the polyester resin [5] was used instead of the polyester resin [1]. Note that, the polyester resin [5] had a weight-average molecular weight of 9,500, a number average molecular weight of 3,100 and a glass-transition temperature of 63° C.

Example 6 of the Manufacturing of the Toner

In (1) resin solution preparation, step of the example 1 of the manufacturing of the toner, a polyester resin [6] was likewise made except that the addition reactant (a compound represented by chemical formula (1) where $R^1$ is a hydrogen atom) of abietic acid and acrylic acid was changed to the addition reactant (a compound represented by chemical formula (3)) of abietic acid and maleic anhydride; a toner [6] was likewise made except that the polyester resin [6] was used instead of the polyester resin [1]. Note that, the polyester resin [6] had a weight-average molecular weight of 9,000, a number average molecular weight of 3,000 and a glass-transition temperature of 63° C.

Example 7 of the Manufacturing of the Toner

In (1) resin solution preparation step of the example 1 of the manufacturing of the toner, a polyester resin [7] was likewise made except that the addition reactant (a compound represented by chemical formula (1) where $R^1$ is a hydrogen atom) of abietic acid and acrylic acid was changed to the addition reactant (a compound represented by chemical formula (2) where $R^2$ is a hydrogen atom) of abietic acid and acrylic acid; a toner [7] was likewise made except that the polyester resin [7] was used instead of the polyester resin [1]. Note that, the polyester resin [7] had a weight-average molecular weight of 9,400, a number average molecular weight of 3,100 and a glass-transition temperature of 61° C.

Example 8 of the Manufacturing of the Toner

In (1) resin solution preparation step of the example 1 of the manufacturing of the toner, a polyester resin [8] was likewise made except that 31 parts by mass of the addition reactant (a compound represented by chemical formula (1) where $R^1$ is a hydrogen atom) of abietic acid and acrylic acid was changed to 16 parts by mass of the addition reactant (a compound represented by chemical formula (1) where $R^1$ is a hydrogen atom) of abietic acid and acrylic acid and 15 parts by mass of the addition reactant (a compound represented by chemical formula (2) where $R^2$ is a hydrogen atom) of abietic acid and acrylic acid; a toner [8] was likewise made except that the polyester resin [8] was used instead of the polyester resin [1]. Note that, the polyester resin [8] had a weight-average molecular weight of 9,900, a number average molecular weight of 3,300 and a glass-transition temperature of 61° C.

Example 9 of the Manufacturing of the Toner

In (1) resin solution preparation step of the example 1 of the manufacturing of the toner, a polyester resin [9] was likewise made except that 31 parts by mass of the addition reactant (a compound represented by chemical formula (1) where $R^1$ is a hydrogen atom) of abietic acid and acrylic acid was changed to 31 parts by mass of the addition reactant (a compound represented by chemical formula (2) where $R^2$ is a methyl group) of abietic acid and metacrylic acid; a toner [9] was likewise made except that the polyester resin [9] was used instead of the polyester resin [1]. Note that, the polyester resin [9] had a weight-average molecular weight of 9,500, a number average molecular weight of 3,200 and a glass-transition temperature of 62° C.

Example 10 of the Manufacturing of the Toner

In (1) resin solution preparation step of the example 1 of the manufacturing of the toner, a polyester resin [10] was likewise made except that 31 parts by mass of the addition reactant (a compound represented by chemical formula (1) where $R^1$ is a hydrogen atom) of abietic acid and acrylic acid was changed to 31 parts by mass of the addition reactant (a compound represented by chemical formula (1) where $R^1$ is —$CH_2COOH$) of abietic acid and itaconic acid; a toner [10] was likewise made except that the polyester resin [10] was used instead of the polyester resin [1]. Note that, the polyester resin [10] had a weight-average molecular weight of 9,800, a number average molecular weight of 3,300 and a glass-transition temperature of 64° C.

Example 11 of the Manufacturing of the Toner

In (1) resin solution preparation step of the example 1 of the manufacturing of the toner, a polyester resin [11] was likewise made except that 31 parts by mass of the addition reactant (a compound represented by chemical formula (1) where $R^1$ is a hydrogen atom) of abietic acid and acrylic acid was changed to 31 parts by mass of the addition reactant (a compound represented by chemical formula (2) where $R^2$ is —$CH_2COOH$) of abietic acid and itaconic acid; a toner [11] was likewise made except that the polyester resin [11] was used instead of the polyester resin [1]. Note that, the polyester resin [11] had a weight-average molecular weight of 9,900, a number average molecular weight of 3,400 and a glass-transition temperature of 64° C.

Examples 1 to 11 of the Manufacturing of the Dry Developing Agent

A ferrite carrier which was coated with silicone resin and in which its volume average particle diameter was 60 nm was mixed with each of the toners [1] to [11] made such that the toner concentration in a developing agent became 6 mass %, with the result that dry developing agents [1] to [11] were made.

Example 1 of the Preparation of the Fixing Agent

As a softening agent, 40 parts by mass of 1,2-propylene carbonate, 0.2 part by mass of sodium dodecyl sulfate and 55 parts by mass of ion exchange water were agitated with an ultrasonic homogenizer for five minutes, and thereafter they were further agitated with the ultrasonic homogenizer for five minutes, with the result that a fixing agent [1] was prepared.

Example 2 of the Preparation of the Fixing Agent

In the example 1 of the preparation of the fixing agent, a fixing agent [2] was likewise made except that 1,2-propylene carbonate was changed to diethoxyethyl succinate.

Example 3 of the Preparation of the Fixing Agent

In the example 1 of the preparation of the fixing agent, a fixing agent [3] was likewise made except that 1,2-propylene carbonate was changed to ethyl 3-hydroxyhexanoate.

Example 4 of the Preparation of the Fixing Agent

In the example 1 of the preparation of the fixing agent, a fixing agent [4] was likewise made except that 40 parts by mass of 1,2-propylene carbonate was changed to 35 parts by mass of 1,2-propylene carbonate and 5 parts by mass of isophoronediamine.

Example 5 of the Preparation of the Fixing Agent

In the example 1 of the preparation of the fixing agent, a fixing agent [5] was likewise made except that 1,2-propylene carbonate was changed to glycol caprylate.

Examples 1 to 33

Comparative Examples 1 to 8

The heating fixing unit of an image forming device "bizhub C 253" (made by Konica Minolta Business Technologies, Inc.) was removed, a fixing unit [1] or [2] described below was installed, the type of dry developing agent, the fixing agent and the fixing unit were made to correspond to combinations shown in tables 1 and 2 below, a solid image was formed on an image support "J paper" (made by Konica Minolta, Inc.) at a toner adherence rate of 12 g/$m^2$. The following evaluation was performed on the obtained solid image. The results are shown in tables 1 and 2.

Fixing Unit [1]

The fixing unit [1] is composed of fixing agent supply means and pressure application means shown in FIG. 2; the fixing agent supply means is composed of a line type inkjet nozzle, and the pressure application means is formed with a pair of pressure rollers.

The line type inkjet nozzle composing the fixing agent supply means has a resolution of 600 dpi and a liquid droplet size of 10 to 15 pl.

As the pair of pressure rollers composing the pressure application means, pressure rollers used in the heating fixing unit of the image forming device "bizhub C 253" were used without heating, and the pressure applied was set at about 200 kPa.

Note that, the amount of the fixing agent supplied was set at 0.4 g/A4.

Fixing Unit [2]

The fixing unit [2] is composed of fixing agent supply means shown in FIG. 4; the fixing agent supply means is composed of a bubble generation device that generates a bubble-like fixing agent, a fixing agent application roller and a pressure roller provided opposite the fixing agent application roller.

The thickness of the bubble-like film supplied by the fixing agent supply means is 50 to 80 μm. Moreover, the pressure applied by the pressure roller is about 200 kPa.

Note that, the amount of fixing agent, supplied was set at 0.4 g/A4.

[Evaluation]

(1) Fixing Strength

The image obtained was folded with a folder obtained by modifying "Finisher FS-608" (made by Konica Minolta Business Technologies, Inc.) and was blown by an air of 0.35

MPa, and limit samples on the state of the fold line were referenced and evaluation was performed based on the following evaluation criteria. The evaluation criteria 3 and higher were regarded as the acceptance level.

—Evaluation Criteria—

5: No separation in the fold line

4: Separation along part of the fold, line

3: Linear separation along the fold line

2: Thick separation along the fold line

1: Large Separation in the Image (2) Document Offset Phenomenon

Two sheets of a double-sided print of the evaluation image described above were continuously output, 20 sheets of printed matter on a marble table were arranged without being changed and a weight was placed on the overlaid part such that a pressure equivalent to 19.6 kPa (200 g/cm$^2$) was applied thereto. They were left, in this state, under an environment in which the temperature was 30° C. and the humidity was 60% RH, for three days, and thereafter the degree of image defect on the toner images overlaid was evaluated based on the following evaluation criteria.

—Evaluation Criteria—

Excellent (A): level in which image failure and the adherence of the toner images resulting from the transfer of the toner are not found, and there is no image defect Good (B): level in which, although a slight sticky feel is recognized when the overlaid prints are separated one after another, there is no image failure or no image defect Practicable (C): level in which, although slight variations in gloss is found on a fixed image when the overlaid prints are separated one sifter another, there is no image failure or no image contamination.

Faulty (D): transfer of the overlaid images to a region where the images are not output is recognized Among them, excellent (A), good (B) and practicable (C) were regarded as being acceptable.

TABLE 1

| | Dry developing agent No. | Toner No. | Polyester resin No. | Chemical formula No. | $R^1$, $R^2$ | The amount of an addition reactant used in an acid component | Fixing agent No. | Fixing unit No. | Evaluation: Fixing strength | Evaluation: Offset |
|---|---|---|---|---|---|---|---|---|---|---|
| Example 1 | Dry developing agent (1) | Toner (1) | Polyester resin (1) | Chemical formula (1) | Hydrogen atom | 11% by mass | Fixing agent (1) | Fixing unit (1) | 4 | B |
| Example 2 | Dry developing agent (1) | Toner (1) | Polyester resin (1) | Chemical formula (1) | Hydrogen atom | 11% by mass | Fixing agent (2) | Fixing unit (1) | 3 | C |
| Example 3 | Dry developing agent (1) | Toner (1) | Polyester resin (1) | Chemical formula (1) | Hydrogen atom | 11% by mass | Fixing agent (3) | Fixing unit (1) | 4 | B |
| Example 4 | Dry developing agent (1) | Toner (1) | Polyester resin (1) | Chemical formula (1) | Hydrogen atom | 11% by mass | Fixing agent (4) | Fixing unit (1) | 3 | C |
| Example 5 | Dry developing agent (3) | Toner (3) | Modified polyester resin (2) | Chemical formula (1) | Hydrogen atom | 11% by mass | Fixing agent (1) | Fixing unit (1) | 4 | A |
| Example 6 | Dry developing agent (3) | Toner (3) | Modified polyester resin (3) | Chemical formula (1) | Hydrogen atom | 11% by mass | Fixing agent (4) | Fixing unit (1) | 5 | A |
| Example 7 | Dry developing agent (5) | Toner (5) | Polyester resin (5) | Chemical formula (1) | Methyl group | 11% by mass | Fixing agent (1) | Fixing unit (1) | 4 | B |
| Example 8 | Dry developing agent (6) | Toner (6) | Polyester resin (6) | Chemical formula (3) | — | 11% by mass | Fixing agent (1) | Fixing unit (1) | 4 | B |
| Example 9 | Dry developing agent (1) | Toner (1) | Polyester resin (1) | Chemical formula (1) | Hydrogen atom | 11% by mass | Fixing agent (1) | Fixing unit (2) | 4 | C |
| Example 10 | Dry developing agent (3) | Toner (3) | Modified polyester resin (3) | Chemical formula (1) | Hydrogen atom | 11% by mass | Fixing agent (4) | Fixing unit (2) | 5 | B |
| Example 11 | Dry developing agent (7) | Toner (7) | Polyester resin (7) | Chemical formula (2) | Hydrogen atom | 11% by mass | Fixing agent (1) | Fixing unit (1) | 3 | B |
| Example 12 | Dry developing agent (8) | Toner (8) | Polyester resin (8) | Chemical formula (1) and Chemical formula (2) | $R^1$: Hydrogen atom $R^2$: Hydrogen atom | 11% by mass | Fixing agent (1) | Fixing unit (1) | 3 | B |
| Example 13 | Dry developing agent (9) | Toner (9) | Polyester resin (9) | Chemical formula (2) | Methyl group | 11% by mass | Fixing agent (1) | Fixing unit (1) | 3 | B |
| Example 14 | Dry developing agent (10) | Toner (10) | Polyester resin (10) | Chemical formula (1) | $—CH_2COOH$ | 11% by mass | Fixing agent (1) | Fixing unit (1) | 3 | B |
| Example 15 | Dry developing agent (11) | Toner (11) | Polyester resin (11) | Chemical formula (2) | $—CH_2COOH$ | 11% by mass | Fixing agent (1) | Fixing unit (1) | 3 | B |
| Example 16 | Dry developing agent (1) | Toner (1) | polyester resin (1) | Chemical formula (1) | Hydrogen atom | 11% by mass | Fixing agent (3) | Fixing unit (2) | 4 | A |
| Example 17 | Dry developing agent (3) | Toner (3) | Modified polyester resin (3) | Chemical formula (1) | Hydrogen atom | 11% by mass | Fixing agent (3) | Fixing unit (1) | 4 | A |
| Example 18 | Dry developing agent (5) | Toner (5) | Polyester resin (5) | Chemical formula (1) | Methyl group | 11% by mass | Fixing agent (3) | Fixing unit (1) | 4 | A |
| Example 19 | Dry developing agent (6) | Toner (6) | Polyester resin (6) | Chemical formula (3) | — | 11% by mass | Fixing agent (3) | Fixing unit (1) | 4 | A |
| Example 20 | Dry developing agent (7) | Toner (7) | Polyester resin (7) | Chemical formula (2) | Hydrogen atom | 11% by mass | Fixing agent (3) | Fixing unit (1) | 4 | A |
| Example 21 | Dry developing agent (8) | Toner (8) | Polyester resin (8) | Chemical formula (1) and Chemical formula (2) | $R^1$: Hydrogen atom $R^2$: Hydrogen atom | 11% by mass | Fixing agent (3) | Fixing unit (1) | 4 | A |
| Example 22 | Dry developing agent (9) | Toner (9) | Polyester resin (9) | Chemical formula (2) | Methyl group | 11% by mass | Fixing agent (3) | Fixing unit (1) | 4 | A |
| Example 23 | Dry developing agent (10) | Toner (10) | Polyester resin (10) | Chemical formula (1) | $—CH_2COOH$ | 11% by mass | Fixing agent (3) | Fixing unit (1) | 4 | A |
| Example 24 | Dry developing agent (11) | Toner (11) | Polyester resin (11) | Chemical formula (1) | $—CH_2COOH$ | 11% by mass | Fixing agent (3) | Fixing unit (1) | 4 | A |
| Example 25 | Dry developing agent (1) | Toner (1) | Polyester resin (1) | Chemical formula (1) | Hydrogen atom | 11% by mass | Fixing agent (6) | Fixing unit (1) | 4 | A |
| Example 26 | Dry developing agent (3) | Toner (3) | Modified polyester resin (3) | Chemical formula (1) | Hydrogen atom | 11% by mass | Fixing agent (6) | Fixing unit (1) | 6 | A |
| Example 27 | Dry developing agent (5) | Toner (5) | Polyester resin (5) | Chemical formula (1) | Methyl group | 11% by mass | Fixing agent (5) | Fixing unit (1) | 4 | A |
| Example 28 | Dry developing agent (6) | Toner (6) | Polyester resin (6) | Chemical formula (3) | — | 11% by mass | Fixing agent (6) | Fixing unit (1) | 4 | B |
| Example 29 | Dry developing agent (7) | Toner (7) | Polyester resin (7) | Chemical formula (2) | Hydrogen atom | 11% by mass | Fixing agent (6) | Fixing unit (1) | 4 | B |
| Example 30 | Dry developing agent (8) | Toner (8) | Polyester resin (8) | Chemical formula (1) and Chemical formula (2) | $R^1$: Hydrogen atom $R^2$: Hydrogen atom | 11% by mass | Fixing agent (5) | Fixing unit (1) | 4 | B |
| Example 31 | Dry developing agent (9) | Toner (9) | Polyester resin (9) | Chemical formula (2) | Methyl group | 11% by mass | Fixing agent (5) | Fixing unit (1) | 4 | B |
| Example 32 | Dry developing agent (10) | Toner (10) | Polyester resin (10) | Chemical formula (1) | $—CH_2COOH$ | 11% by mass | Fixing agent (5) | Fixing unit (1) | 4 | B |
| Example 33 | Dry developing agent (11) | Toner (11) | Polyester resin (11) | Chemical formula (2) | $—CH_2COOH$ | 11% by mass | Fixing agent (5) | Fixing unit (1) | 4 | B |

TABLE 2

| | Dry developing agent No. | Toner No. | Polyester resin No. | Chemical formula No. | $R^1$, $R^2$ | The amount of an addition reactant used in an acid component | Fixing agent No. | Fixing unit No. | Evaluation Fixing strength | Evaluation Offset |
|---|---|---|---|---|---|---|---|---|---|---|
| Comparative Example 1 | Dry developing agent (2) | Toner (2) | Polyester resin (2) | Chemical formula (1) | Hydrogen atom | 3.4% by mass | Fixing agent (1) | Fixing unit (1) | 2 | C |
| Comparative Example 2 | Dry developing agent (2) | Toner (2) | Polyester resin (2) | Chemical formula (1) | Hydrogen atom | 3.4% by mass | Fixing agent (2) | Fixing unit (1) | 1 | C |
| Comparative Example 3 | Dry developing agent (2) | Toner (2) | Polyester resin (2) | Chemical formula (1) | Hydrogen atom | 3.4% by mass | Fixing agent (2) | Fixing unit (1) | 2 | C |
| Comparative Example 4 | Dry developing agent (2) | Toner (2) | Polyester resin (2) | Chemical formula (1) | Hydrogen atom | 3.4% by mass | Fixing agent (4) | Fixing unit (1) | 1 | C |
| Comparative Example 5 | Dry developing agent (4) | Toner (4) | Modified Polyester resin (4) | Chemical formula (1) | Hydrogen atom | 3.4% by mass | Fixing agent (1) | Fixing unit (1) | 2 | C |
| Comparative Example 6 | Dry developing agent (4) | Toner (4) | Modified Polyester resin (4) | Chemical formula (1) | Hydrogen atom | 3.4% by mass | Fixing agent (4) | Fixing unit (1) | 2 | C |
| Comparative Example 7 | Dry developing agent (2) | Toner (2) | Polyester resin (2) | Chemical formula (1) | Hydrogen atom | 3.4% by mass | Fixing agent (1) | Fixing unit (2) | 2 | C |
| Comparative Example 8 | Dry developing agent (4) | Toner (4) | Modified Polyester resin (4) | Chemical formula (1) | Hydrogen atom | 3.4% by mass | Fixing agent (4) | Fixing unit (2) | 2 | C |

DESCRIPTION OF THE SYMBOLS

10 image forming device
20 intermediate transfer member
21A, 21B, 21C support roller
30Y, 30M, 30C, 30K image formation unit
31 toner image carrier
31Y, 31M, 31C. 31K photoreceptor
32Y, 32M, 32C, 32K charging means
33Y, 33M, 33C, 33K exposure means
34Y, 34M, 34C, 34K developing means
35Y, 35M, 35C, 35K primary transfer means
36Y, 36M, 36C, 36K cleaning means
40 secondary transfer means
50, 50A, 50B, 50C fixing agent supply means
51 fixing agent application roller
52 pressure roller
53 metaling blade
54 bubble generation device
55 fixing agent application roller
56 pressure roller
57 regulation blade
60 cleaning means
70 pressure application means
B bubble-like film
F fixing agent
M liquid film
T toner image
P image support

What is claimed is:

1. An image forming method comprising:

an electrostatic latent image formation process of forming an electrostatic latent image on an electrostatic latent image carrier;

a development process of forming a toner image by developing the electrostatic latent image with a dry developing agent including a toner containing a binder resin including a polyester resin;

a transfer process of transferring the toner image to an image support; and a fixing agent supply process of supplying a fixing agent for swelling or dissolving the toner to the toner image transferred to the image support, wherein the polyester resin forming the binder resin of the toner is obtained by condensing and polymerizing a carboxylic component containing at least one compound selected from chemical formula (1), chemical formula (2) and chemical formula (3) shown below that is an addition reactant of abietic acid and a carboxylic compound having an unsaturated double bond and an alcohol component, and the content of at least the one compound selected from the chemical formula (1), the chemical formula (2) and the chemical formula (3) in the carboxylic component is 5% by mass or more, and the fixing agent contains an alkylene carbonate which may have a substituent group or an aliphatic alkyl carboxylic acid ester which may have a substituent group;

Chemical formula (1)

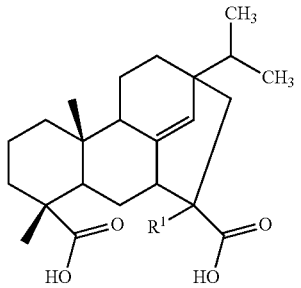

[where $R^1$ is a hydrogen atom, a methyl group or —$CH_2COOH$;]

Chemical formula (2)

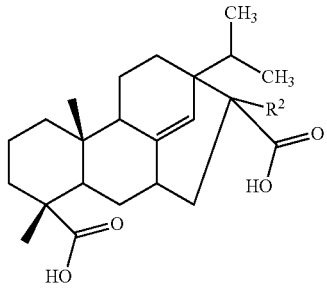

[where $R^2$ is a hydrogen atom, a methyl group or —$CH_2COOH$;]

Chemical formula (3)

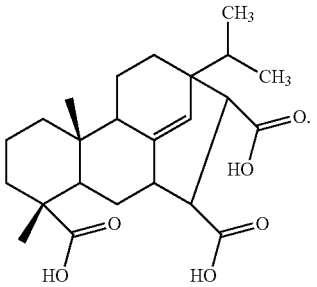

2. The image forming method of claim 1, wherein in the chemical formula (1), $R^1$ is a hydrogen atom.

3. The image forming method of claim 1, wherein in the chemical formula (2), $R^2$ is a hydrogen atom.

4. The image forming method of claim 1, wherein the aliphatic alkyl carboxylic acid ester is ethyl 3-hydroxyhexanoate or glycol caprylate.

5. The image forming method of claim 1, wherein the fixing agent contains 1,2-propylene carbonate.

6. The image forming method of claim 1, wherein a part or the whole of the polyester resin forming the binder resin of the toner is isocyanate-modified, and the fixing agent contains water and a polyvalent amine compound.

7. The image forming method of claim 6, wherein the polyvalent amine compound is isophoronediamine.

* * * * *